US007275403B2

(12) United States Patent
Meyer

(10) Patent No.: US 7,275,403 B2
(45) Date of Patent: Oct. 2, 2007

(54) LONGITUDINAL CURVATURE ADJUSTMENT ASSEMBLY FOR A RAIN GUTTER ROLL FORMING MACHINE

(75) Inventor: Bruce E. Meyer, 119 Sinclair St. SE., Port Charlotte, FL (US) 33952

(73) Assignees: Englert, Inc., Perth Amboy, NJ (US); Bruce E. Meyer, Port Charlotte, FL (US)

( * ) Notice: Subject to any disclaimer, the term of this patent is extended or adjusted under 35 U.S.C. 154(b) by 92 days.

(21) Appl. No.: 11/300,745

(22) Filed: Dec. 15, 2005

(65) Prior Publication Data

US 2007/0137276 A1 Jun. 21, 2007

(51) Int. Cl.
*B21D 5/08* (2006.01)

(52) U.S. Cl. ..... 72/178

(58) Field of Classification Search ..... 72/179–182, 72/52, 178

See application file for complete search history.

(56) References Cited

U.S. PATENT DOCUMENTS

| | | | | |
|---|---|---|---|---|
| 606,306 | A * | 6/1898 | Shann | 72/178 |
| 1,366,331 | A * | 1/1921 | Palmer et al. | 72/178 |
| 2,458,906 | A * | 1/1949 | Himmel et al. | 72/178 |

* cited by examiner

*Primary Examiner*—Daniel C Crane
(74) *Attorney, Agent, or Firm*—David L. Davis

(57) ABSTRACT

A rain gutter roll forming machine wherein the final forming station has the exit drive rollers removed therefrom. The forming rollers for the lower front and back corners of the gutter are mounted for rotation about a single substantially horizontal axis and are supported by a camber adjustment plate. The camber adjustment plate is pivotable about a pivot point which is substantially within the plane of the bottom wall of the gutter. Accordingly, the relative pressures applied to the gutter by the corner forming rollers can be varied to compensate for longitudinal curvature of the gutter due to differential drag on the front and back gutter walls.

9 Claims, 6 Drawing Sheets

LONGITUDINAL CURVATURE ADJUSTMENT ASSEMBLY FOR A RAIN GUTTER ROLL FORMING MACHINE

BACKGROUND OF THE INVENTION

This invention relates to a roll forming machine for producing a rain gutter and, more particularly, to an improved final forming station to insure that the formed rain gutter has a desired longitudinal curvature.

Roll forming machines for producing rain gutters are generally well known. In such a machine, the gutters are formed from a supply coil of sheet metal which is finished on a first side so that the exterior of the finished gutter has an aesthetically pleasing appearance. As the sheet metal is driven through the machine along a predetermined path of travel, its lateral profile is gradually transformed from a flat sheet into a downwardly concave trough having a desired lateral profile and with the finished side of the sheet metal forming the exterior surface of the trough. As the finished gutter exits the machine, it passes through a cutting station including a shear assembly which may be selectively activated to sever the gutter so that a desired length of finished gutter is separated from the partially finished gutter which remains in the machine. In the case where the front and back walls of the gutter do not have the same number of bends, this results in different amounts of drag on the front and back walls, causing the front and back walls to be of slightly different lengths. If the front and back walls are of different lengths, this causes the formed gutter to have longitudinal curvature. This curvature is not necessarily a bad thing. Some gutter installers prefer a longitudinal curvature where the ends of the gutter are curved toward the building on which the gutter is being installed; some installers prefer the reverse curvature; and other installers prefer no curvature. It would therefore be desirable to have a mechanism within the roll forming machine whereby the longitudinal curvature of the formed gutter can be controlled to compensate for the differential drag on the front and back gutter walls.

SUMMARY OF THE INVENTION

The present invention finds utility in a roll forming machine for forming a rain gutter, wherein the rain gutter is in the form of a trough having a back wall, a front wall and a bottom wall connecting the back and front walls. The roll forming machine includes a final forming station which is operative to form the corners between the bottom wall and the back and front walls of the gutter. According to this invention, this final forming station comprises a first pair of corner forming rollers, a first of which rotates about a substantially horizontal axis and the second of which rotates about a vertical axis, for forming the back corner, and a second pair of corner forming rollers, a first of which rotates about a substantially horizontal axis and the second of which rotates about a vertical axis, for forming the front corner. A plate holds the two first corner forming rollers to rotate about a single substantially horizontal axis and an adjustment mechanism is selectively operable to rotate the plate so as to vary the angle of the single axis relative to the bottom wall of the rain gutter.

In accordance with an aspect of this invention, the adjustment mechanism is further selectively operable to move the plate so as to vary the vertical position of the single axis relative to the bottom wall of the rain gutter.

BRIEF DESCRIPTION OF THE DRAWINGS

The foregoing will be more readily apparent upon reading the following description in conjunction with the drawings in which like elements in different figures are identified by the same reference numeral and wherein.

DETAILED DESCRIPTION

Figure 1:
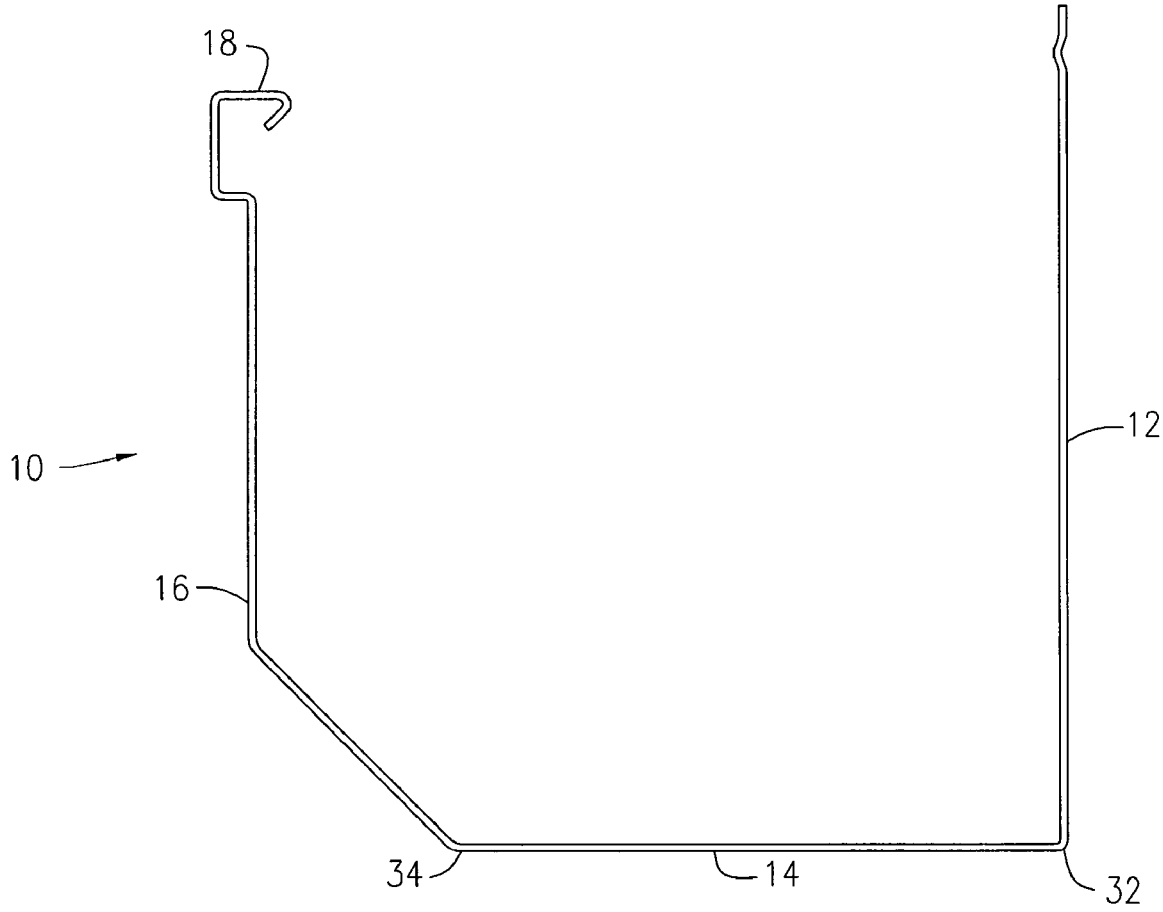
FIG. 1 shows an exemplary rain gutter lateral profile which can be produced by a roll forming machine incorporating the present invention.

Referring to the drawings, FIG. 1 shows the profile of an exemplary rain gutter, designated generally by the reference numeral 10, which can be produced by a roll forming machine incorporating structure embodying the present invention. The gutter 10 is generally in the form of a downwardly concave trough having a back wall 12, a bottom wall 14 and a front wall 16. As is the general practice in the art, the back wall 12 is designed to abut supporting structure on a building to which the gutter 10 is attached, and therefore cannot be seen by an observer. However, the front wall 16 is designed to be visible from outside the building and therefore it is desired that the exterior surface of the front wall 16 be finished to provide an aesthetically pleasing appearance. To provide strength to the gutter 10, the upper end 18 of the front wall 16 is bent and folded, as shown in the drawing.

Figure 2:
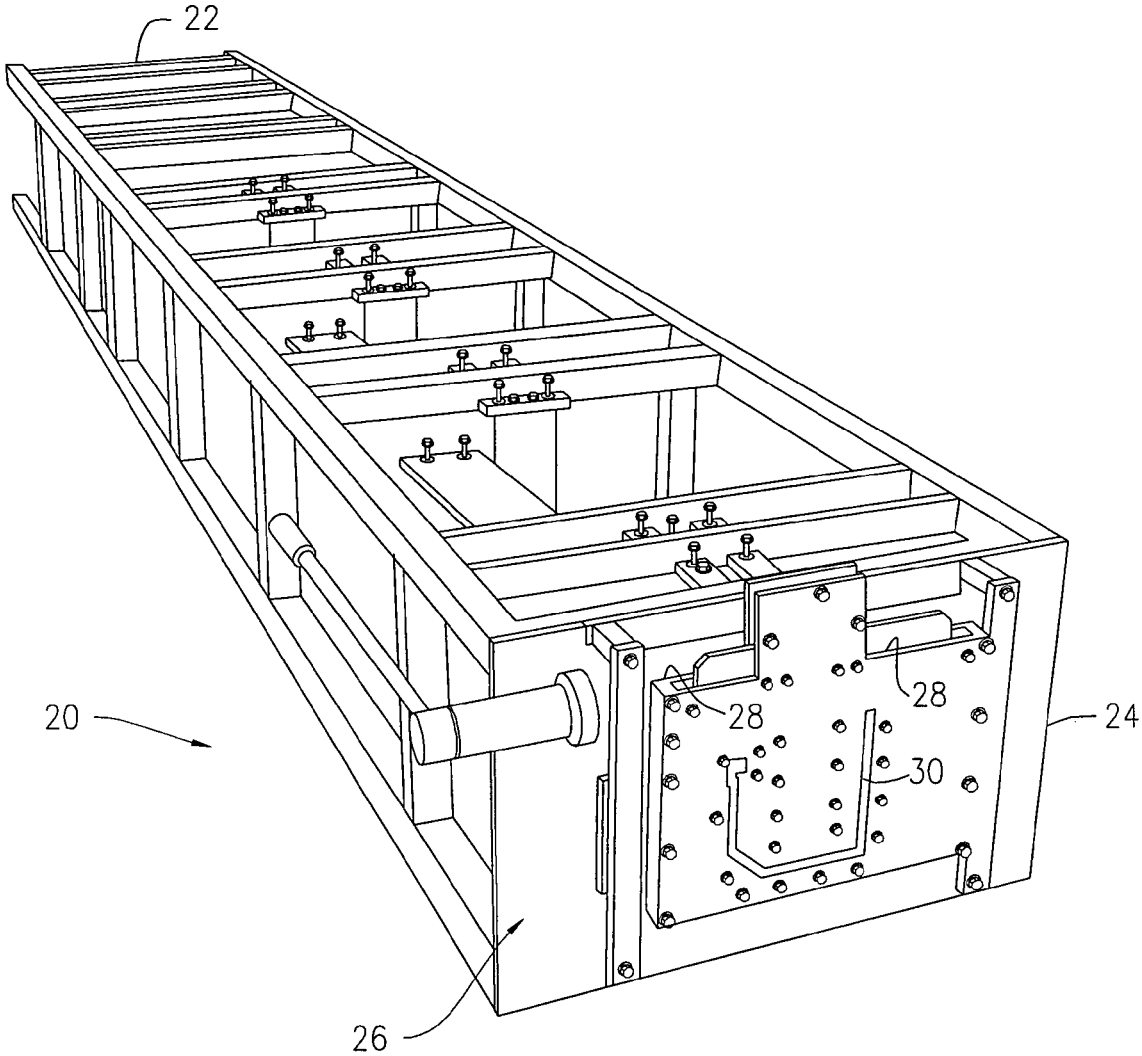
FIG. 2 is a perspective view of an exemplary roll forming machine in which structure constructed according to the present invention is incorporated.
Figure 3:
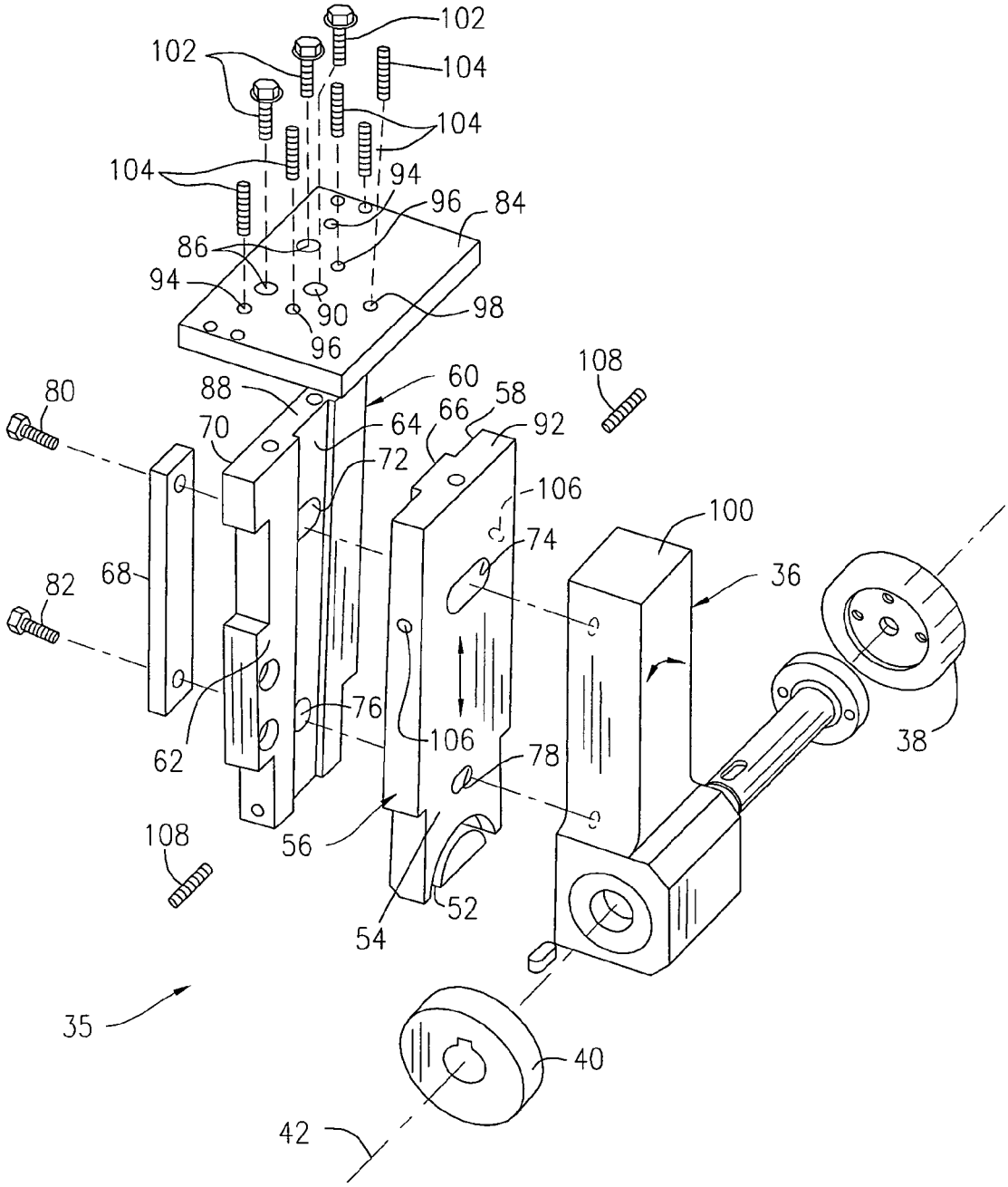
FIG. 3 is a schematic exploded perspective view of an illustrative embodiment of the final forming station of the machine shown in FIG. 2, including the inventive adjustment mechanism.

FIG. 2 shows a roll forming machine, designated generally by the reference numeral 20, which may be used for forming the gutter 10. As is conventional, the machine 20 has a spindle (not shown) near its entry end 22 for supporting a supply coil of sheet metal (not shown). The sheet metal supply coil is of uniform width and has a pair of parallel straight edges. The sheet metal is finished, as by painting for example, on one side so that the exterior surface of the formed gutter 10 is finished. As is known in the roll forming art, the supply coil is pulled by driven rollers so as to travel through the machine 20 along a predetermined path past a plurality of spaced roll forming stations. As the supply coil is pulled through the machine 20, each successive roll forming station operates to gradually transform the lateral profile of the sheet metal from a flat sheet to the profile shown in FIG. 1. Thus, the sheet metal starts as a flat sheet with its finished side on the bottom and gradually assumes a downwardly concave trough-like shape with its finished side on the outside of the gutter. At the exit end 24 of the machine 20 is a cutting station 26 for cutting the formed gutter to a desired length. The cutting station 26 includes a pair of spaced parallel die plates 28 between which a cutting blade (not shown) is selectively moved. Each of the die plates 28 has a respective opening 30 aligned with the opening of the other die plate through which the finished gutter passes as it exits the machine 20. The openings 30 have generally the same shape as the profile of the finished gutter, but are larger so that the finished gutter passes freely therethrough. The foregoing is well known in the art of roll forming machines and does not form a part of the present invention.

The present invention is concerned with the forming station which forms the lower back corner 32 and the lower front corner 34 of the gutter 10. This station is the final roll forming station in the machine 20, immediately prior to the cutting station 26. As is clear from FIG. 1, before the gutter reaches this final station, the front wall 16 has had five bends formed therein, whereas the back wall 12 has no bends. Accordingly, more drag has been imparted to the front wall 16 than to the back wall 12, which means that the back wall 12 is slightly longer than the front wall 16 at this point, providing a longitudinal curvature to the gutter 10. If this longitudinal curvature is not compensated for, the ends of the gutter would curve away from the building to which it is to be mounted. It is known that such compensation can be effected by causing the rollers which form the front corner 34 to apply more pressure to the gutter than the rollers which form the back corner 32. Until now, it was conventional to mount the final corner forming rollers on the same shaft as the drive rollers of the exit drive assembly. However, with this conventional arrangement, it is very difficult to vary the forming pressure to compensate for the longitudinal curvature without causing unintended side effects due to also adjusting the exit drive rollers.

According to the present invention this problem is overcome by separating the exit drive rollers from the corner forming rollers at the final forming station of the roll forming machine 20 and providing an adjustment assembly as part of the final forming station, independent of the exit drive rollers. As shown in FIGS. 3-6, the inventive final forming station 35 includes a camber adjustment plate 36 which supports the corner forming rollers 38 and 40 for rotation about a single substantially horizontal axis 42. The corner forming roller 38 cooperates with the corner forming roller 44, which rotates about a first vertical axis, to form the lower back corner 32 and the corner forming roller 40 cooperates with the corner forming roller 46, which rotates about a second vertical axis, to form the lower front corner 34 as the bottom wall 14 of the gutter 10 passes between the forming rollers 38,40 and the lower support roller 48. Note that in the illustrative gutter 10, the lower front corner 34 subtends an angle of 135°, but the inventive concept is operative with any corner angle.

Figure 4:
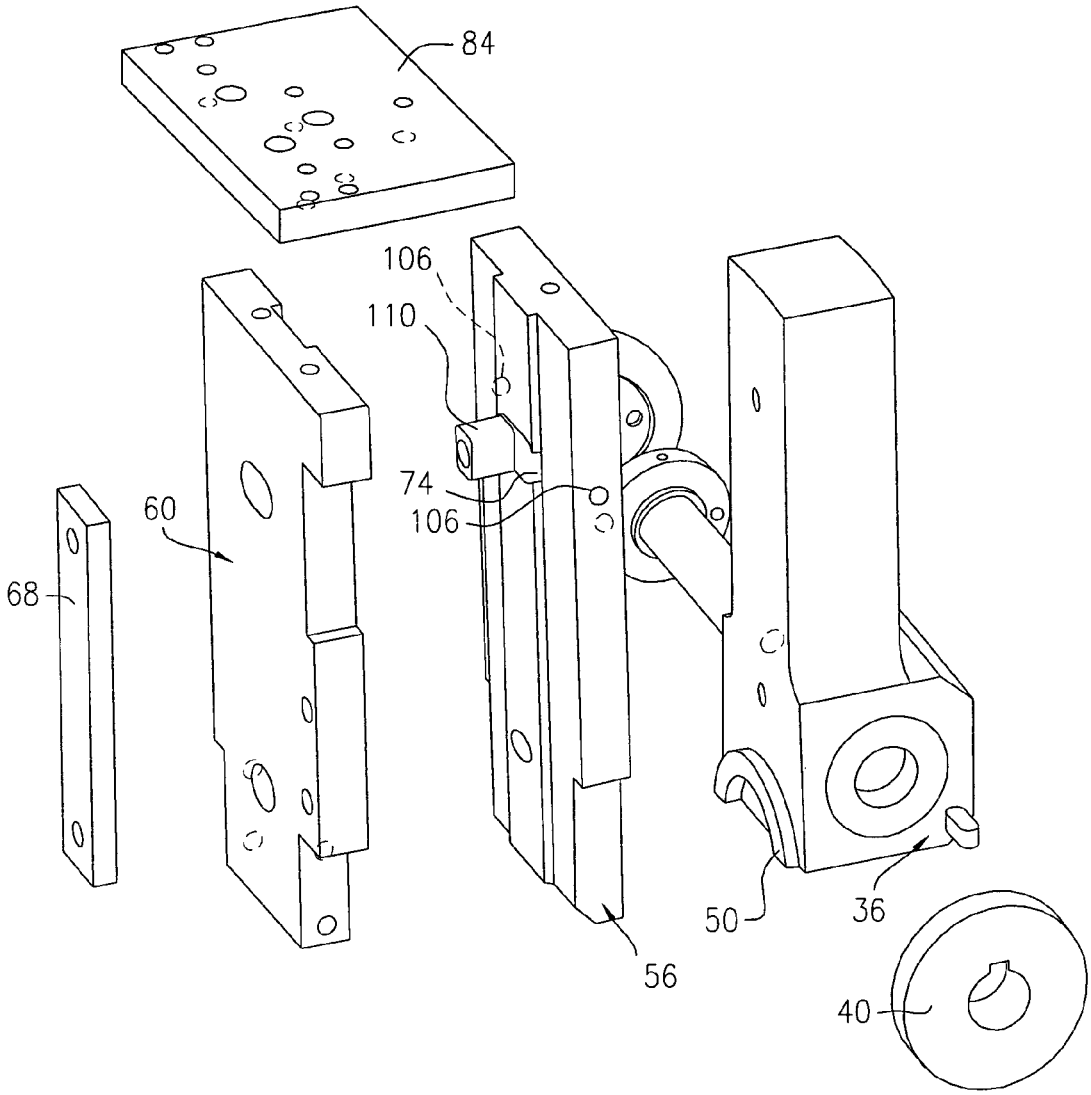
FIG. 4 is a schematic exploded perspective view similar to FIG. 3 but from a different angle, with some parts removed for purposes of clarity.
Figure 5:
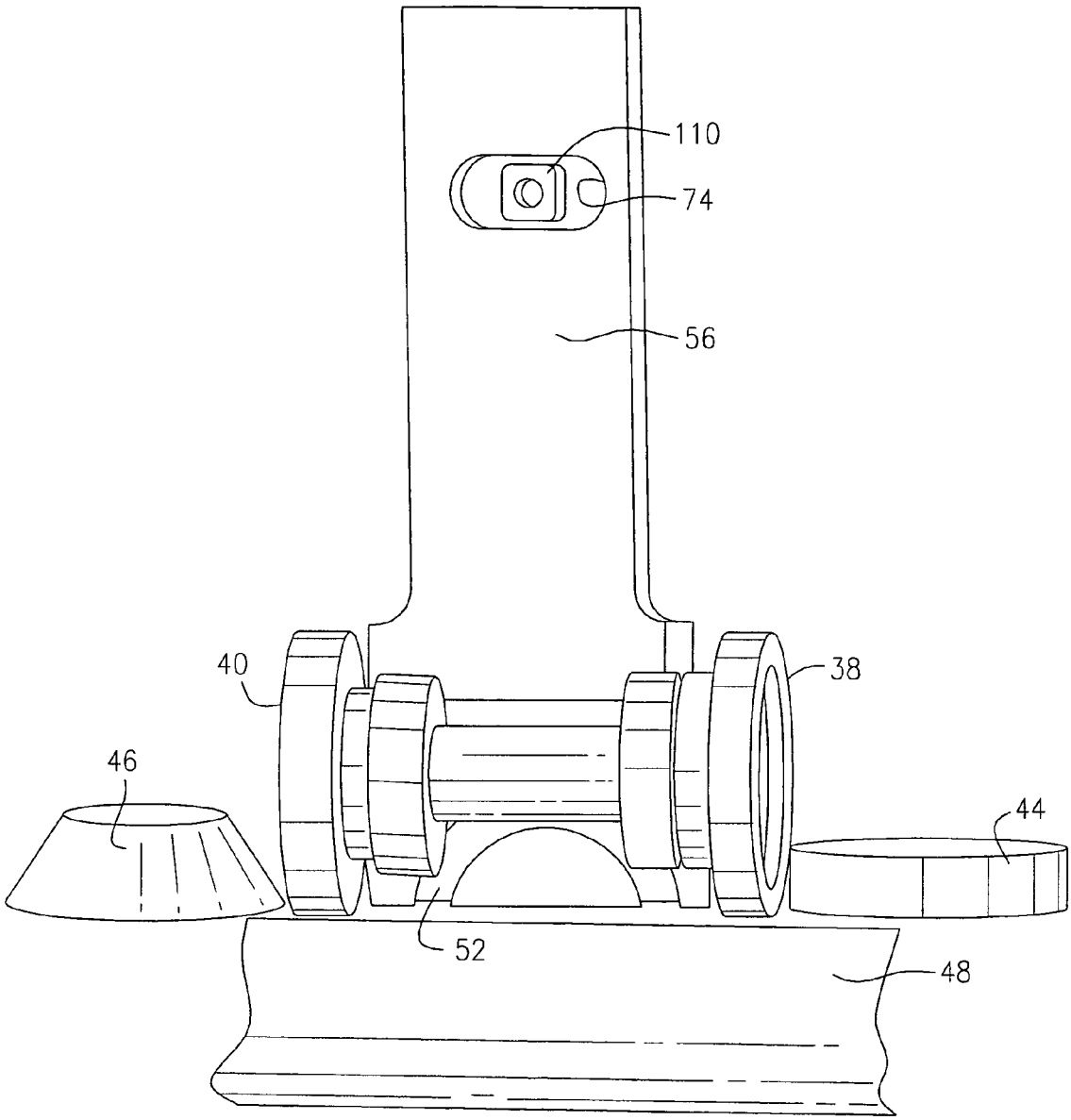
FIG. 5 is a perspective end view, with some parts removed for purposes of clarity, illustrating the final forming station shown in FIGS. 3 and 4.
Figure 6:
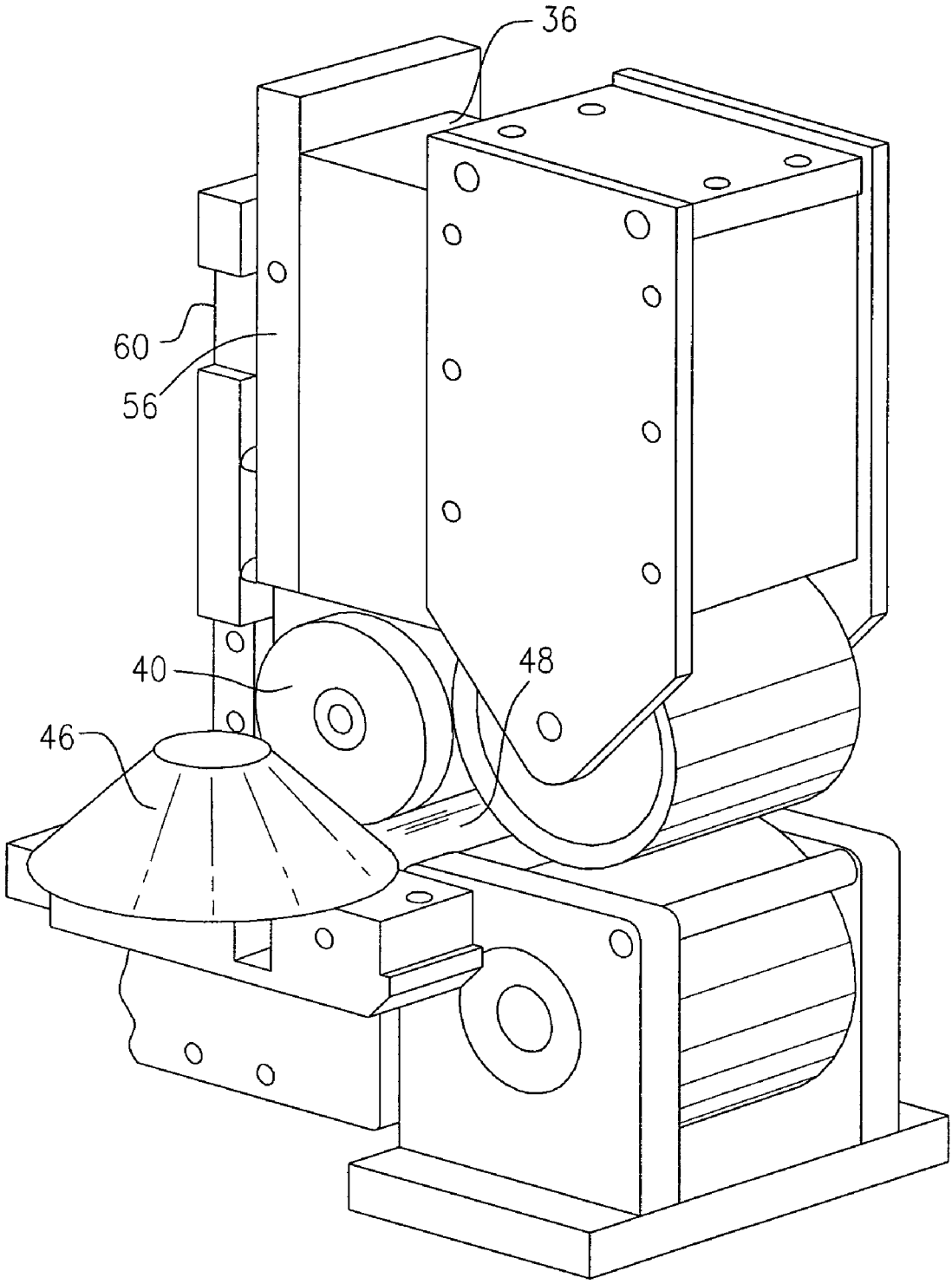
FIG. 6 is a perspective view, with some parts removed for purposes of clarity, illustrating the assembled final forming station shown in FIGS. 3 and 4.

The camber adjustment plate 36 is arranged to be pivotable about a pivot point substantially in the horizontal plane of the bottom wall 14 of the gutter 10 to vary the angle of the axis 42 relative to that plane, resulting in the relative pressures applied by the corner forming rollers 38,40 being varied. To effect such pivoting, there is provided a boss 50 extending out of the camber adjustment plate 36 orthogonal to the axis 42 and parallel to the horizontal plane of the bottom wall 14 of the gutter 10. As best shown in FIG. 4, the boss 50 has a circular arcuate shape and is received and slidable in a complemental circular arcuate groove 52 formed in a first side 54 of a vertical adjustment plate 56. The first side 54 of the vertical adjustment plate 56 is adjacent to the camber adjustment plate 36 and the radial center of the groove 52 defines the pivot point of the camber adjustment plate 36. The radial center of the groove 52 is therefore substantially in the horizontal plane of the bottom wall 14 of the gutter 10. Adjacent to the second side 58 of the vertical adjustment plate 56 is a support plate 60 which is fixed to the frame of the machine 20. The first side 62 of the support plate 60 is adjacent to the second side 58 of the vertical adjustment plate 56 and is formed with a straight vertical groove 64. The second side 58 of the vertical adjustment plate 56 is formed with an elongated protruding boss 66 slidable in the groove 64. Accordingly, the vertical adjustment plate 56 is movable vertically relative to said support plate 60 and is constrained against lateral movement relative to the support plate 60. (It is understood that, alternatively, the groove 64 could be on the vertical adjustment plate and the boss 66 could be on the support plate to achieve the same result.)

A clamp bar 68 is provided adjacent to a second side 70 of the support plate 60. The support plate 60 and the vertical adjustment plate 56 are formed with aligned oversize upper openings 72 and 74, respectively, and with aligned lower openings 76 and 78, respectively. A headed bolt 80 extends through a first opening in the clamp bar 68 and through the aligned upper openings 72,74 and is threaded into the camber adjustment plate 36. Similarly, a headed bolt 82 extends through a second opening in the clamp bar 68 and through the aligned lower openings 76,78 and is threaded into the camber adjustment plate 36. The heads of the bolts 80,82 are larger than the respective openings in the clamp bar 68 through which they extend. The bolts 80,82 can be tightened to the camber adjustment plate 36 to clamp together the clamp bar 68, the support plate 60, the vertical adjustment plate 56 and the camber adjustment plate 36.

A horizontal plate 84 is fixed to the frame of the machine 20 and overlies the support plate 60, the vertical adjustment plate 56 and the camber adjustment plate 36. The horizontal plate 84 has a pair of openings 86 aligned with an upper edge 88 of the support plate 60, an opening 90 aligned with an upper edge 92 of the vertical adjustment plate 56, a first pair 94 of threaded bores aligned with the upper edge 88 of the support plate 60 and flanking the pair of openings 86 of the horizontal plate 84, a second pair 96 of threaded bores aligned with the upper edge 92 of the vertical adjustment plate 56 and flanking the opening 90 of the horizontal plate 84, and a threaded bore 98 aligned with an upper edge 100 of the camber adjustment plate 36. Bolts 102 extend through the openings 86,90 and are threadedly secured to the upper edges 88,92. Jack screws 104 are threaded into the threaded bores 94,96,98 to abut against the upper edges 88,92,100. This arrangement secures the assembly against vertical movement after all vertical adjustments have been made.

To enable pivotal adjustment of the camber adjustment plate 36, the vertical adjustment plate 56 is formed with a pair of co-linear threaded bores 106 which extend into the vertical adjustment plate 56 from respective opposed side edges thereof. The bores 106 are in open communication with the opening 74, through which the bolt 80 passes, the bolt 80 being secured to the camber adjustment plate 36. Jack screws 108 are threaded into the threaded bores 106 to abut against opposed sides of a sleeve 110 which is slidable laterally within the opening 74 and through which the bolt 80 extends. By moving the jack screws 108 in and out when the bolts 80,82 are loosened to unclamp the assembly, the camber adjustment plate 36 is caused to pivot about the radial center of the arcuate groove 52, varying the angle of the axis 42 and varying the relative pressures applied to the bottom wall 14 of the gutter 10 by the corner forming rollers 38,40. Since the pivot point of the camber adjustment plate is low, (i.e., within the plane of the gutter bottom wall), there is virtually no lateral movement of the corner forming rollers 38,40 caused by pivoting the camber adjustment plate 36.

This is advantageous because lateral movement of the corner forming rollers 38,40 would affect formation of the corners 32,34, which would then have to be compensated for, an iterative process which could take a substantial amount of time.

Accordingly, there has been disclosed an improved longitudinal curvature adjustment assembly for a rain gutter roll forming machine. While an illustrative embodiment of the inventive assembly has been disclosed herein, it will be appreciated by those of skill in the art that various modifications and adaptations to the disclosed embodiment are possible. It is therefore intended that this invention be limited only by the scope of the appended claims.

What is claimed is:

1. In a roll forming machine having a frame and being operative to form a rain gutter of indeterminate length from a supply coil of sheet metal, wherein the rain gutter is in the form of a trough having a back wall, a front wall and a bottom wall connecting the back and front walls, wherein the front wall has a greater number of bends in its lateral profile than the back wall, wherein the corners between the bottom wall and the back and front walls are formed at a final station of the machine immediately prior to the formed gutter exiting the machine, and wherein each corner is formed at the final station by a respective pair of corner forming rollers a first of which rotates about a substantially horizontal axis and the second of which rotates about a vertical axis, an adjustment mechanism at the final station to compensate for additional drag imparted to the front wall relative to the back wall due to the additional bends of the front wall and to provide a desired longitudinal curvature to the formed rain gutter, the adjustment mechanism comprising:

a camber adjustment plate holding both first corner forming rollers for rotation about a single substantially horizontal axis;

a vertical adjustment plate secured relative to the frame of the machine and having a first side adjacent to said camber adjustment plate, said vertical adjustment plate having a circular arcuate groove in said first side, said vertical adjustment plate having a first opening therethrough extending from said first side, wherein the radial center of said circular arcuate groove is in the plane of the bottom wall of the gutter as it passes through the final station;

a boss extending out of said camber adjustment plate orthogonal to said single axis, said boss having a circular arcuate shape complemental to said circular arcuate groove of said vertical adjustment plate so that said boss is receivable and slidable in said groove;

a rod secured to said camber adjustment plate and passing through the first opening of said vertical adjustment plate, wherein the rod is sized relative to the first opening so that it can be moved within the first opening orthogonal to its length; and means associated with said vertical adjustment plate for selectively moving said rod orthogonal to its length so that said camber adjustment plate is pivoted about the radial center of said circular arcuate groove to vary the angle of said single axis relative to a horizontal plane;

whereby the relative pressures applied to the bottom wall of the gutter by the two first corner forming rollers can be controlled to lengthen the front corner relative to the back corner so as to compensate for the additional drag on the front wall.

2. The adjustment mechanism according to claim 1 further comprising:

a support plate fixed to the frame of the machine and having a first side adjacent to a second side of said vertical adjustment plate; and a clamp bar adjacent to a second side of said support plate;

wherein said support plate has a first opening extending therethrough from its first side to its second side and alignable with said vertical adjustment plate first opening;

wherein said clamp bar has a first opening therethrough alignable with the first openings of said support plate and said vertical adjustment plate; and wherein said rod comprises a first bolt threadedly secured to said camber adjustment plate and extending through the first openings of said vertical adjustment plate, said support plate and said clamp bar, said first bolt having an enlarged head remote from said camber adjustment plate and sized larger than the first opening of said clamp bar, whereby said first bolt can be tightened to said camber adjustment plate to clamp together said clamp bar, said support plate, said vertical adjustment plate and said camber adjustment plate.

3. The adjustment mechanism according to claim 2, wherein said clamp bar, said support plate and said vertical adjustment plate are each formed with a respective second opening therethrough, said adjustment mechanism further comprising:

a second bolt extending parallel to said first bolt and through the second openings of said clamp bar, said support plate and said vertical adjustment plate, said second bolt being threadedly secured to said camber adjustment plate.

4. The adjustment mechanism according to claim 2, wherein said first side of said support plate and said second side of said vertical adjustment plate are each formed with a respective one of a straight vertical groove and an elongated protruding boss slidable in said groove, whereby said vertical adjustment plate is movable vertically relative to said support plate and is constrained against lateral movement relative to said support plate.

5. The adjustment mechanism according to claim 4, further comprising:

a horizontal plate fixed to the frame of the machine and overlying said support plate and said vertical adjustment plate, said horizontal plate having a first opening aligned with an upper edge of said support plate, a second opening aligned with an upper edge of said vertical adjustment plate, a first pair of threaded bores aligned with said upper edge of said support plate and flanking said first opening of said horizontal plate, and a second pair of threaded bores aligned with said upper edge of said vertical adjustment plate and flanking said second opening of said horizontal plate;

a pair of bolts each extending through a respective one of said first and second openings of said horizontal plate and threadedly secured to said upper edge of a respective one of said support plate and said vertical adjustment plate; and four jack screws each threaded into a respective one of said first and second pairs of threaded bores of said horizontal plate.

6. The adjustment mechanism according to claim 5, wherein said horizontal plate overlies said camber adjustment plate and is formed with a third threaded bore aligned with an upper edge of said camber adjustment plate, said adjustment mechanism further comprising:

a jack screw threaded into said third threaded bore of said horizontal plate.

7. The adjustment mechanism according to claim 1, wherein said vertical adjustment plate is formed with a pair of co-linear threaded bores each extending into said vertical adjustment plate from a respective opposed side edge of said vertical adjustment plate and into communication with said first opening of said vertical adjustment plate, and said means for selectively moving said rod comprises:

a pair of jack screws each threaded into a respective one of said pair of threaded bores.

8. A final forming station in a rain gutter roll forming machine, wherein the rain gutter is in the form of a trough having a back wall, a front wall and a bottom wall connecting the back and front walls, wherein the final forming station is operative to form the corners between the bottom wall and the back and front walls of the gutter, the final forming station comprising:

a plate;

a first pair of corner forming rollers, a first of which is mounted to said plate for rotation about a substantially horizontal axis and the second of which is mounted independently of said plate for rotation about a vertical axis, the first and second rollers cooperating with one another with the first roller engaging the bottom wall for forming the front corner;

a second pair of corner forming rollers, a first of which is mounted to said plate for rotation about said substantially horizontal axis and the second of which is mounted independently of said plate for rotation about a vertical axis, the first and second rollers cooperating with one another with the first roller engaging the bottom wall for forming the front corner;

an adjustment mechanism selectively operable to rotate the plate so as to vary the angle of the substantially horizontal axis of the first rollers relative to the bottom wall of the rain gutter.

9. The final forming station according to claim 8, wherein the adjustment mechanism is further selectively operable to move the plate so as to vary the vertical position of the substantially horizontal axis relative to the bottom wall of the rain gutter.

* * * * *